US006276335B1

(12) United States Patent
Egler et al.

(10) Patent No.: US 6,276,335 B1
(45) Date of Patent: Aug. 21, 2001

(54) FUEL INJECTION VALVE

(75) Inventors: Walter Egler, Gerlingen; Peter Boehland, Steinheim; Lorenz Betz, Burgebrach; Ralf Hentschel, Munich, all of (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/465,843

(22) Filed: Dec. 17, 1999

(30) Foreign Application Priority Data

Dec. 22, 1998 (DE) ..... 198 59 537

(51) Int. Cl.[7] ..... F02M 37/04; F02D 1/06
(52) U.S. Cl. ..... 123/446; 239/124
(58) Field of Search ..... 123/446, 447, 123/467, 514, 468; 239/88–96, 124

(56) References Cited

U.S. PATENT DOCUMENTS 5,464,156 * 11/1995 Ricco et al. ..... 239/124
5,694,903 * 12/1997 Ganser ..... 123/496
5,890,653 * 4/1999 Kelly ..... 239/124
5,975,428 * 11/1999 Rotschin ..... 239/88
6,102,302 * 8/2000 Nishimura ..... 239/96
6,145,492 * 11/2000 Lixl ..... 239/96

* cited by examiner

*Primary Examiner*—Thomas N. Moulis
(74) *Attorney, Agent, or Firm*—Ronald E. Greigg; Edwin E. Greigg

(57) ABSTRACT

A fuel injection valve for high-pressure injection of fuel from a central high-pressure line into combustion chambers of an internal combustion engine, which includes a switching valve with a valve seat and a valve ball; the valve ball in the opened state is lifted from the valve seat by means of a high-pressure jet which is supplied from a throttle bore by a pressure chamber operatively connected to a central high-pressure line. The transition from the throttle bore to the valve seat is embodied as a diffuser.

12 Claims, 2 Drawing Sheets

FUEL INJECTION VALVE

BACKGROUND OF THE INVENTION

The invention is based on a fuel injection valve of the type known from European Patent Disclosure EP 0 690 223 A2.

In so-called common rail systems, the injection nozzles for the various cylinders of the engine are supplied with fuel from a central high-pressure line. To assure the lowest possible emissions, low fuel consumption and quiet engine operation, all the injection valves must inject the fuel exactly identically into the engine. This can be assured only if all the injection valves have the same opening behavior at exactly the same time at an operating point.

For accurate control of the injection event with common rail systems, electromagnetic or piezoelectrically controlled valves, which are located in front of the actual injection valve, are therefore known from the prior art. In a fuel injection valve of this kind, the nozzle needle is moved via a control piston. The control piston is moved via the pressure in the control chamber. The precision of the injection event is determined by the motion of the control piston, which depends on the pressure in the control chamber and thus on the flow through throttles and a switching valve.

OBJECT AND SUMMARY OF THE INVENTION

It is therefore an object of the present invention to create a fuel injection valve for high-pressure injection of fuel from a central high-pressure line into combustion chambers, in which the opening and closing operation of the switching valve and the flow of fuel through the switching valve are controllable as precisely as possible.

The fuel injection valve according to the invention has an advantage that the hydraulic flow through the switching valve can be specified precisely, even at low rail pressure and a short valve stroke. To that end, the flow upstream of the switching valve is constricted and expanded in a purposeful way, using an especially designed throttle geometry. After the contraction through the throttle inlet, the fuel flow expands again in such a way, given the throttle geometry according to the invention, in the direction of the throttle wall that because of an optimal pressure difference at the valve, the hydraulic flow is increased, and the opening motion of the valve ball away from the valve seat is reinforced.

Because of the advantageous design of the throttle, the flow resistance is reduced, so that even at a short switching valve stroke and a low rail pressure, a high flow is brought about. The high flow leads to a high-flow velocity at the entrance into the throttle.

The static pressure therefore drops down to the vapor pressure of the fuel, and vapor formation, or in other words cavitation, occurs. As a result of this effect, which ensues, given the throttle geometry of the invention, at the lowest possible rail pressures and shortest possible switching valve strokes, the hydraulic flow is now determined only by the pressure upstream of the throttle and by the inlet geometry (given a constant fuel temperature and a constant fuel type) and is independent of the valve stroke. Because of the defined hydraulic flow, the injection onset, which is electronically controlled via the corresponding switching valves, of a plurality of injection nozzles that are supplied from a common high-pressure line is reliably synchronized.

In a preferred embodiment, the diameter of a diffuser at the transition to the cone seat is only slightly less than the seat diameter. As a result, the largest possible hydraulic cross section of the valve as the valve ball lifts from the seat is attained.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
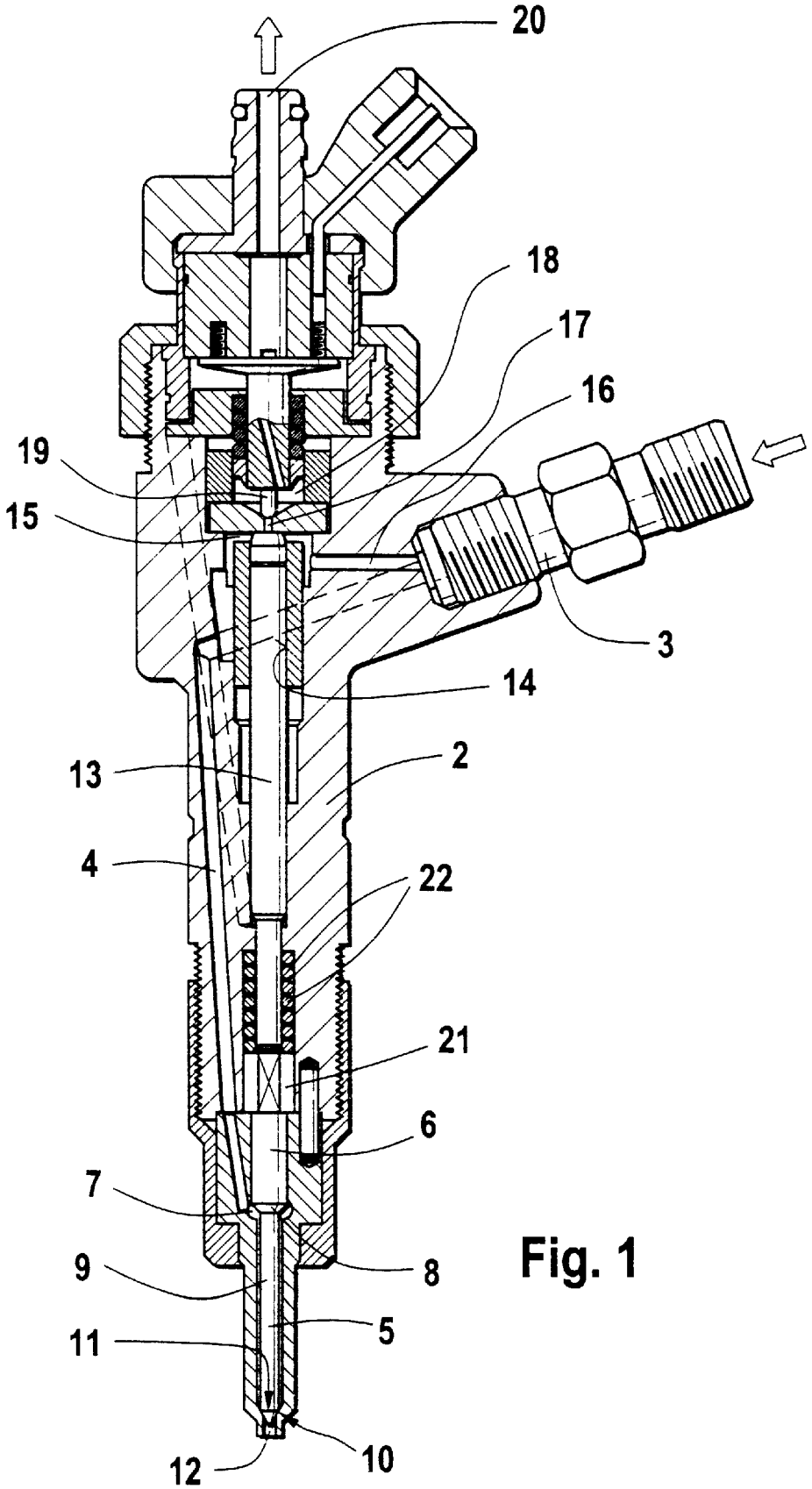
FIG. 1 is a sectional view of a complete common rail injector.

In FIG. 1, an injector is shown. The fuel injection valve has a housing 2, which is connected to a connection 3 for supplying fuel, brought to injection pressure, from a high-pressure fuel reservoir not otherwise shown. Disposed in the housing 2 of the fuel injection valve is an injection valve needle 5, which has a guide portion 6 that changes, at a shoulder located inside the pressure chamber 7, into a smaller-diameter part 9 of the injection valve needle. At the end of this smaller-diameter part 9, this part has a conical sealing face 10, which cooperates with a valve seat 11 and thus opens or closes the injection openings 12, depending on the position of the injection valve needle.

The pressure chamber 7 communicates constantly with the connection 3 via a pressure line 4, so that the pressure chamber 7 is constantly at high injection pressure. The needle 5 is controlled via the pressure piece 21 and the control piston 13. The control piston plunges into a cylinder 14, in which on the face end the cylinder encloses a control pressure chamber 15. The control pressure chamber communicates constantly with the connection 3 via a throttle bore 16. A throttle bore 17 also leads away from the control pressure chamber 15, and its outlet discharges into a relief chamber 18 via an electrical valve 19. The flow through the throttle bore 17 is controlled via the electrical valve 19. The relief chamber is connected to a return line via an outlet stub 20 on the housing 2.

In operation, the fuel injection valve described above is supplied with high pressure from the high-pressure fuel reservoir via the connection 3. This pressure, acting on the shoulder 8, urges the fuel injection valve needle 5 to lift, so that fuel can flow out of the pressure chamber 7 along the smaller-diameter part 9 of the injection valve needle to the injection openings 12 and emerge from them. This opening action is counteracted by the spring 22, but this spring alone does not suffice to keep the injection valve needle 5 in the closing position when high-fuel pressure is prevailing in the pressure chamber 7, although it does so when high-fuel pressure is absent. The task of closure continues to be performed by the pressure in the control pressure chamber 15, which when the electrically actuated valve 19 is closed is the same as the pressure in the pressure chamber 7. Because of the larger end face area of the control piston 14, the closing force predominates, and the valve remains closed. For tripping the injection, the electrically actuated valve 19 is opened, so that the pressure chamber 15 is relieved, uncoupled by the throttle bore 16, and thus the opening force on the shoulder 8 predominates. To terminate the injection event, the electrically actuated valve 19 is closed again.

Figure 2:
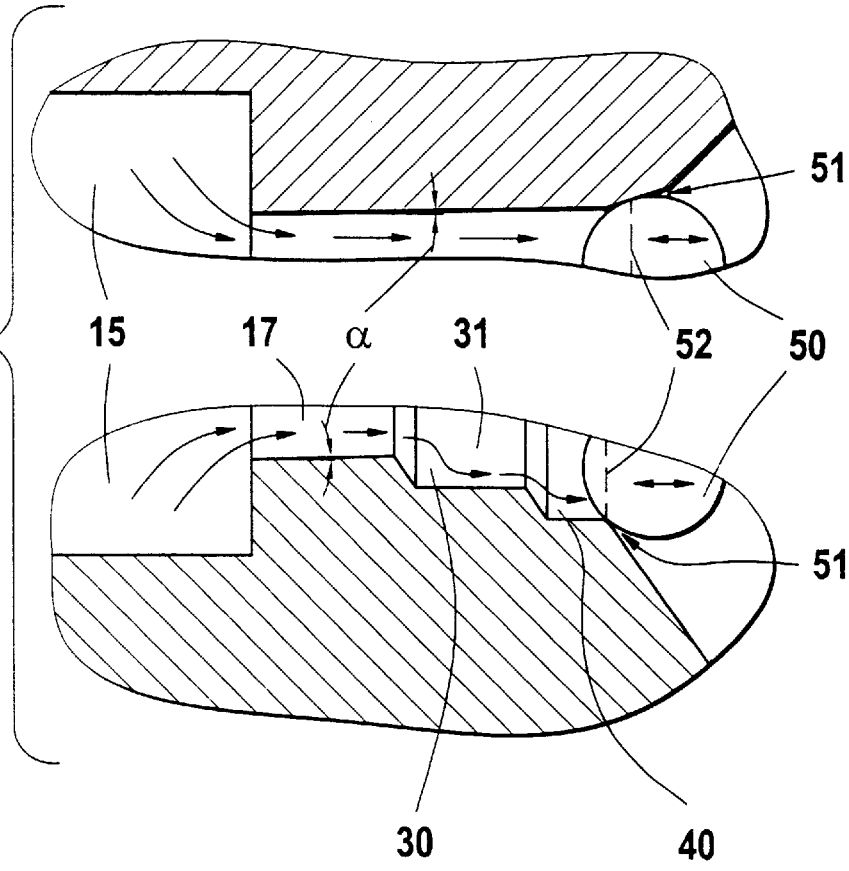
FIG. 2 shows two embodiments of the invention.

In FIG. 2, the two embodiments of the invention are shown in section. The upper portion shows an embodiment with a throttle bore 31 that widens in the flow direction conically as far as the conical seat of the ball valve 50. The cone angles $\alpha$ are designed for maximum pressure recovery in the flow. The lower portion shows an embodiment in which once again a maximum pressure recovery is brought about by means of the throttle bore 17, which widens conically with the angle α in the flow direction, and two diffusers 30 and 40 connected in series.

Upon injection, the fuel flows out of the pressure chamber 15 into the throttle bore 17 or 31, gaining speed in the process. At the same time, the static pressure at the inlet to the throttle bore decreases. In the region of the diffuser 30, the flow presses against the wall (see the schematic illustration of the fuel flow represented by the arrows in FIG. 1), spreads out, and at the same time increases its speed. The second diffuser 40 reinforces this process, and as a result the static pressure within the flow increases with the flow direction. This increased static pressure, upon opening of the switching valve, reinforces the motion of the valve ball 50 in the flow direction and therefore speeds up the increase in the fuel flow through the switching valve. At the same time, the increased fuel flow increases the tendency to cavitation at the beginning of the throttle.

In an especially preferred embodiment, the diameter of the second diffuser 40 is only slightly less than the diameter of the valve seat line 52. As a result, when the valve ball 50 moves in the flow direction (see double arrow in FIG. 1), a maximum flow cross section is made available.

To further enhance the pressure recovery and the tendency to cavitation, the throttle bore 17 is also preferably widened conically in the flow direction and preferably has a cone angle α of up to 5°.

As can be seen clearly from FIG. 1, the throttle bore 17, the two diffusers 30, 40 or 31 and the valve seat 51 are oriented in colinear fashion and together form a funnel, whose wider opening is closed and opened by the valve ball 50.

The foregoing relates to preferred exemplary embodiments of the invention, it being understood that other variants and embodiments thereof are possible within the spirit and scope of the invention, the latter being defined by the appended claims.

We claim:

1. A fuel injection valve for high-pressure injection of fuel from a central high-pressure line into combustion chambers of an internal combustion engine, said fuel injection valve includes a switching valve (19) with a valve seat (51) and a valve ball (50), in the open state of the switching valve the control pressure chamber (15) is operatively connected to a relief chamber through a throttle bore (17), the throttle bore having an inlet positioned near control pressure chamber (15), and the transition from the throttle bore inlet to the valve seat (51) is embodied as a diffuser.

2. The fuel injection valve according to claim 1, in which the diffuser is embodied as a conical diffuser (31), a stepped diffuser (30, 40), or a combination of the two, and the diffuser is embodied in such a way that the fuel flow presses essentially against the diffuser wall.

3. The fuel injection valve according to claim 1, in which the diameter at the transition to the seat cone is preferably only slightly smaller than the seat diameter (51).

4. The fuel injection valve according to claim 2, in which the diameter at the transition to the seat cone is preferably only slightly smaller than the seat diameter (51).

5. The fuel injection valve according to claim 1, in which the diffuser is embodied such that the flow presses against the diffuser wall to an extent, allowing for maximal pressure recovery.

6. The fuel injection valve according to claim 2, in which the diffuser is embodied such that the flow presses against the diffuser wall to an extent, allowing for maximal pressure recovery.

7. The fuel injection valve according to claim 3, in which the diffuser is embodied such that the flow presses against the diffuser wall to an extent, allowing for maximal pressure recovery.

8. The fuel injection valve according to claim 1, in which the throttle bore, the entire diffuser (40), and the valve seat (51) form a funnel, relative to whose central opening the valve ball is movable.

9. The fuel injection valve according to claim 2, in which the throttle bore, the entire diffuser (40), and the valve seat (51) form a funnel, relative to whose central opening the valve ball is movable.

10. The fuel injection valve according to claim 3, in which the throttle bore, the entire diffuser (40), and the valve seat (51) form a funnel, relative to whose central opening the valve ball is movable.

11. The fuel injection valve according to claim 3, in which the throttle bore, the entire diffuser (40), and the valve seat (51) form a funnel, relative to whose central opening the valve ball is movable.

12. A fuel injection valve for high-pressure injection of fuel from a central high-pressure line into combustion chambers of an internal combustion engine, said fuel injection valve includes:

a control pressure chamber (15), connected to a high pressure source of fluid by a throttle (16);

a relief chamber (18);

and a throttle bore (17) connected at its first end to said control chamber (15), and at its second end to said relief chamber (18); said fuel injection valve further including;

a switching valve (19) positioned near the second end of the throttle bore (17), wherein, in the open state of the switching valve (19), the control pressure chamber (15) is operatively connected to the relief chamber (18), and in the closed state of switching valve (19) the control pressure chamber is closed from the relief chamber (18), the throttle bore (17) having an inlet near its first end, and being formed to widen from its inlet to the switching valve such that when the switching valve is opened and fluid from the control pressure chamber (15) flows out through the throttle bore (17), the flow of the fluid is increased by the widening of the throttle bore (17).

* * * * *